US007452147B2

(12) United States Patent
Rolion et al.

(10) Patent No.: US 7,452,147 B2
(45) Date of Patent: Nov. 18, 2008

(54) WRITING INSTRUMENT WITH A LATERAL BUTTON

(75) Inventors: Franck Rolion, Belloy (FR); Frédéric Duchesne, Frepillon (FR); Jeanne-Antide Bouveresse, Rueil Malmaison (FR)

(73) Assignee: Societe BIC, Clichy Cedex (DE)

( * ) Notice: Subject to any disclaimer, the term of this patent is extended or adjusted under 35 U.S.C. 154(b) by 5 days.

(21) Appl. No.: 10/576,174

(22) PCT Filed: Oct. 20, 2004

(86) PCT No.: PCT/FR2004/002685

§ 371 (c)(1),
(2), (4) Date: Mar. 16, 2007

(87) PCT Pub. No.: WO2005/039888

PCT Pub. Date: May 6, 2005

(65) Prior Publication Data

US 2007/0231048 A1 Oct. 4, 2007

(30) Foreign Application Priority Data

Oct. 22, 2003 (FR) ..... 03 12332

(51) Int. Cl.
*B43K 21/16* (2006.01)

(52) U.S. Cl. ..... 401/65; 401/82; 401/92; 401/93; 401/94

(58) Field of Classification Search ..... 401/53, 401/55, 56, 65–67, 82, 85, 88, 92–94, 99, 401/104–106, 109, 112, 117
See application file for complete search history.

(56) References Cited

U.S. PATENT DOCUMENTS

| | | | | |
|---|---|---|---|---|
| 3,071,112 | A * | 1/1963 | Lovejoy et al. | 401/106 |
| 3,883,253 | A | 5/1975 | Naruse et al. | |
| 5,704,694 | A * | 1/1998 | Kozakai | 303/113.2 |
| 6,065,889 | A * | 5/2000 | Maruyama et al. | 401/65 |
| 6,817,800 | B2 * | 11/2004 | Sung | 401/93 |

FOREIGN PATENT DOCUMENTS

| | | |
|---|---|---|
| EP | 0 806 305 B1 | 11/1997 |

* cited by examiner

*Primary Examiner*—David J Walczak
*Assistant Examiner*—Jason K Niesz
(74) *Attorney, Agent, or Firm*—Jones Day

(57) ABSTRACT

A writing instrument that includes a tubular body extending along a longitudinal axis between a rear end and a front end provided with an opening through which a writing tip is capable of protruding, a lateral button having at least one actuation face oriented radially outward and at least one first cam arranged inside the body, and a writing tip advancing mechanism that include a movable member movable in a longitudinal direction in the body. The movable member includes at least a first ramp inclined relative to the longitudinal axis, the lateral button is capable of remaining in a rest position in which the first cam is facing the first ramp, and the lateral button is capable of making a first tilting movement toward the inside of the body during which the first cam interacts with the first ramp and the movable member makes a first movement.

11 Claims, 3 Drawing Sheets

WRITING INSTRUMENT WITH A LATERAL BUTTON

This is a national stage application of International Patent Application No. FR2004/002685, filed Oct. 20, 2004.

The embodiments of the present invention relates to a writing instrument, and particularly, but not exclusively, to a propelling pencil, comprising a tubular body extending along a longitudinal axis between a rear end and a front end provided with an opening through which a writing tip is capable of protruding, a lateral button having at least one actuation face oriented radially outward and at least one first cam arranged inside the body, and a writing tip advancing mechanism comprising a member longitudinally movable in the body, which has at least a first ramp inclined relative to the longitudinal axis, the lateral button being capable of remaining in a rest position in which the first cam is facing the first ramp, and capable of making a first tilting movement toward the inside of the body during which the first cam interacts with the first ramp and the movable member makes a first movement.

BACKGROUND OF THE INVENTION

Writing instruments provided with a lateral button for causing the writing tip to advance, as described for example in document U.S. Pat. No. 3,883,253, have the advantage for the user of keeping the instrument in the writing position in his hand when it is necessary to cause the writing tip to move forward or to protrude. With this type of writing instrument, it is at most necessary for the user to move his index finger along the body to actuate the lateral button. This is particularly advantageous with propelling pencils which require regular actuation of the lead advancing mechanism as the lead is used up.

However, the lateral buttons of the prior art have the disadvantage of being able to cause a relatively slight longitudinal movement of the advancing mechanism. Specifically, the active stroke of the button's cam against the ramp of the advancing mechanism is limited by the internal diameter of the tubular body and, consequently, it is not possible to obtain a considerable stroke without excessively enlarging the diameter of the body and while retaining an appropriate incline of the ramp, so that the pressure to be exerted on the button remains acceptable. In addition, because of the presence of a tube in the center of the tubular body, such as for example a lead storage compartment, the lateral button is prominent on the outside of the body, which may make it awkward to hold the writing instrument and make it more difficult to actuate the lateral button without changing the hand gripping of the writing instrument.

SUMMARY OF THE INVENTION

The embodiments of the present invention is to alleviate the aforementioned disadvantages by providing a writing instrument furnished with a lateral button and an advancing mechanism capable of causing a greater longitudinal movement of the writing tip, and particularly in the case of a propelling pencil in which the forward stroke of the movable member comprises a first portion which serves to advance the lead, and a second portion which serves to cause a lead-guide tip mounted movably in the front end of the body to protrude.

Accordingly, the embodiments of the present invention include a writing instrument of the aforementioned type characterized in that the lateral button has at least a second cam longitudinally distant from the first cam, and in that the movable member has a bearing substantially parallel to the longitudinal axis that is adjacent to at least one second inclined ramp, the second cam resting on the bearing during the first tilting movement of the lateral button, and the lateral button being capable of making a second tilting movement toward the inside of the body during which the second cam interacts with the second ramp and the movable member makes a second movement.

Thanks to this arrangement, the movable member of the advancing mechanism can be moved using a single lateral button which makes two tilting movements toward the inside of the body. The effect of each of these tilting movements on the movable member may be substantially equal to the effect obtained with a lateral button of the prior art, and consequently, by causing a first and a second movement of the movable member in the same direction, it is possible either to substantially double the longitudinal movement of the writing tip, or to reduce by half the radial inward movement of the lateral button assembly and thus to reduce the portion of this button that protrudes from the body.

It will be noted that this double tilting movement may be obtained by a single pressure exerted by the user approximately in the middle of the actuation face of the lateral button and thus be virtually imperceptible for the user. Specifically, from the rest position and under the action of a radial pressure, the lateral button naturally makes the first tilting movement due to the disposition of the first cam facing the first ramp and the presence of the bearing of the movable member on which the second cam rests, then the button makes the second tilting movement virtually automatically due to the fact that the second cam is facing the second ramp at the end of the first tilting movement.

But it can be envisaged that the actuation face is intended to be pressed at one and then the other of its longitudinal ends, for example, to cause a first and a second movement of the movable member which would have different effects, or to cause a first and a second movements of the movable member in opposite directions.

In preferred embodiments of the present invention, it is also possible to use one or other of the following dispositions in which:

the body has an abutment, and the first cam has at least one contact point that is in contact against said abutment of the body during the second tilting movement of the lateral button, in order to limit the friction between the lateral button and the movable member;

at least one of the ramps of the movable member has a height, measured in a radial direction, substantially equal to the internal space of the tubular body;

the lateral button has, respectively at the first and the second cams, a first and a second U-shaped cross section, the ends of the branches of the U of said first and second cross sections forming respectively said first and second cams;

the first ramp of the movable member is situated at the front end of the body and the second ramp is situated at the rear end;

the advancing mechanism comprises an elastic element which forces the movable member toward the rear end of the body, the incline of the first and second ramps being adapted so that the first and second movements are made toward the front end of the body;

the writing tip is a lead and the advancing mechanism comprises a lead clamping chuck that is connected to the movable member;

the chuck is held closed under the action of at least one elastic element which forces said chuck and the movable member toward the rear end of the body;

the movable member has a central duct allowing at least one lead to pass through and in which the first and second ramps are respectively formed by a first and a second pair of inclined surfaces situated either side of said central duct;

a lead storage compartment is secured to the movable member and extends up to the rear end provided with a rear button emerging from the rear end of the body so that it is possible to cause the lead to advance with the aid of the rear button;

a lead-guide tip is mounted so as to slide in the front end of the body between a retracted position and a protruding position, and the first movement of the movable member is suitable for advancing and opening the chuck, and the second movement of the movable member is suitable for pushing the lead-guide tip into the protruding position.

BRIEF DESCRIPTION OF THE DRAWINGS

Other features and advantages of the invention will appear during the following description, given as a nonlimiting example, with reference to the appended drawings in which.

In the various figures, the same reference numerals have been retained to identify identical or similar elements.

DETAILED DESCRIPTION

Figure 1:
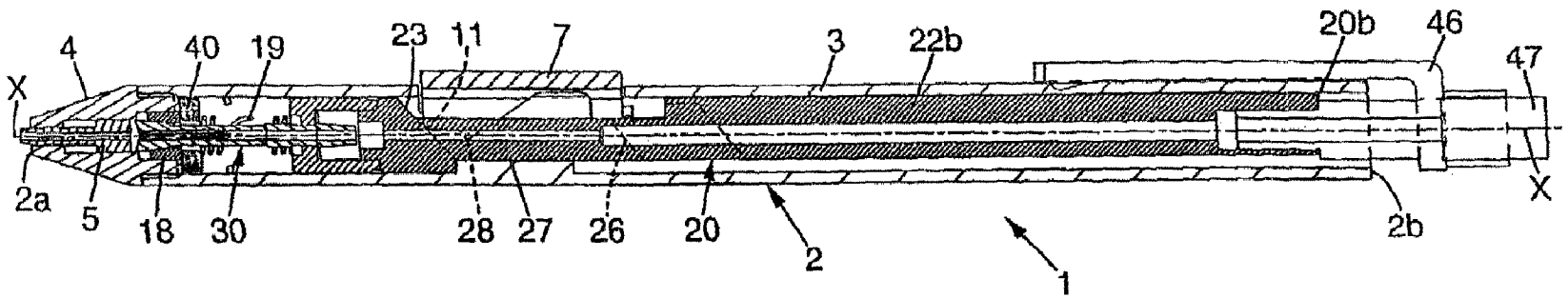
FIG. 1 is a view in longitudinal section of a propelling pencil comprising a lateral button and an advancing mechanism according to an embodiment of the present invention and in which the lateral button is in the rest position.

FIG. 1 represents a propelling pencil 1 comprising a tubular body 2 which extends along a longitudinal axis X between a front end 2*a* and a rear end 2*b*.

In the embodiment represented, the body 2 is formed of a tube 3 and a tip 4 arranged at the front end of the body 2.

The tip 4 has at its front end an opening through which a lead-guide tip 5 passes that is mounted to slide freely in a bore 4*a* of the tip 4. The lead-guide tip 5 accompanies the emergence of the lead 6 to prevent the lead from breaking. When the wear of the lead reaches the end of the lead-guide tip, the latter touches the paper and makes a retraction movement which releases the end of the lead and allows writing to continue.

A lateral button 7 is mounted through a rectangular window 8 that is formed in the radial wall of the tubular body 2, and extends along the longitudinal axis X. The lateral button 7 has an actuation surface 9 oriented radially outward.

Figure 5:
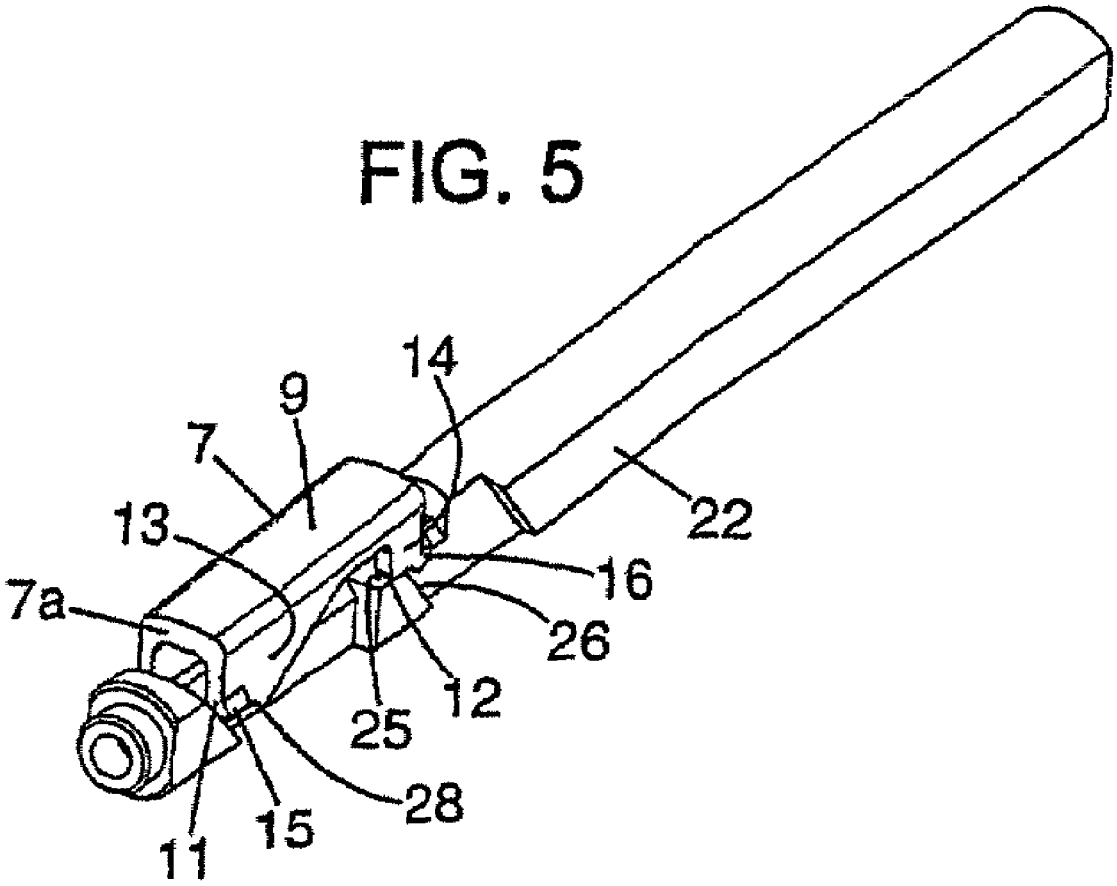
FIG. 5 is a view in perspective of the lateral button and of a section of the advancing mechanism represented in FIG. 1.

The lateral button 7 has a first pair of cams 11 arranged at the front end of the lateral button and in a manner opposed to the actuation face 9. As can be better seen in FIG. 5, the front end 7*a* of the button has a U-shaped cross section, the base of the U forming the actuation face 9 and the branches of the U forming two wings 13 which extend toward the inside of the tubular body and whose end front portion is of rounded shape so as to form each of the first cams 11.

The rear end 7*b* of the lateral button also has a U-shaped cross section. In a manner similar to the front end 7*a*, the branches of the rear U-shaped section form two wings 14 and the inner end of these wings each has a rounded section at the front end 7*a* side which form a second pair of cams 12.

It will be noted that the first pair of cams 11 is spaced from the second pair of cams 12 along the axis X, which is close to the longitudinal length of the actuation face 9 of the lateral button 7.

The end of the outer face of the wings 13 comprises a first lug 15 (see FIG. 5) which protrudes radially outward. The inner end of the rear wings 14 comprises a second lug 16 which protrudes toward the rear end 2*b* of the body 2. The first 15 and second 16 lugs interact with the inner periphery of the window 8 and thus prevent the lateral button 7 from completely coming out of the tubular body 2.

Inside the tubular body 2, an advancing mechanism is arranged that comprises a movable member 20, a chuck 30, a sleeve 40, a clamping ring 18 and a spring 19 placed between the movable member 20 and the sleeve 40.

The movable member 20 is mounted so as to slide along the longitudinal axis X in the tubular body 2. In the embodiment shown, the movable member 20 comprises a front piece 21 which forms the front end 20*a* of the movable member and a main piece 22 attached to the front piece 21. The main piece 22 comprises a front section situated at the front end 20*a* of the movable member, which will be explained in detail hereinafter, and a hollow rear section 22*b* which forms a lead storage compartment. It is possible for the lead storage compartment to be formed by an independent piece attached to the movable member 20.

The chuck 30 comprises a tubular section 31 which, in the exemplary embodiment shown, is mounted so as to slide over a determined length in the front piece 21 of the movable member, and a head 32 which interacts in a known manner with the clamping ring 18 to immobilize the lead 6.

The sleeve 40 is mounted so as to slide in the body 2 and move relative to the chuck 30. In the rest position, the sleeve is held against the tip 4 and the clamping ring 18 by the spring 19.

The front section of the main piece 22 of the movable member 20 has a first pair of ramps 23 that are identical and arranged at the front end 20*a* of the movable member. The first ramps 23 are situated on either side of a central duct 24 allowing the leads to pass from the storage compartment toward the chuck 30. Each first ramp 23 has a rectilinear surface inclined relative to the longitudinal axis X.

In the embodiment shown, the first ramps 23 are oriented toward the rear of the body 2.

Figure 2:
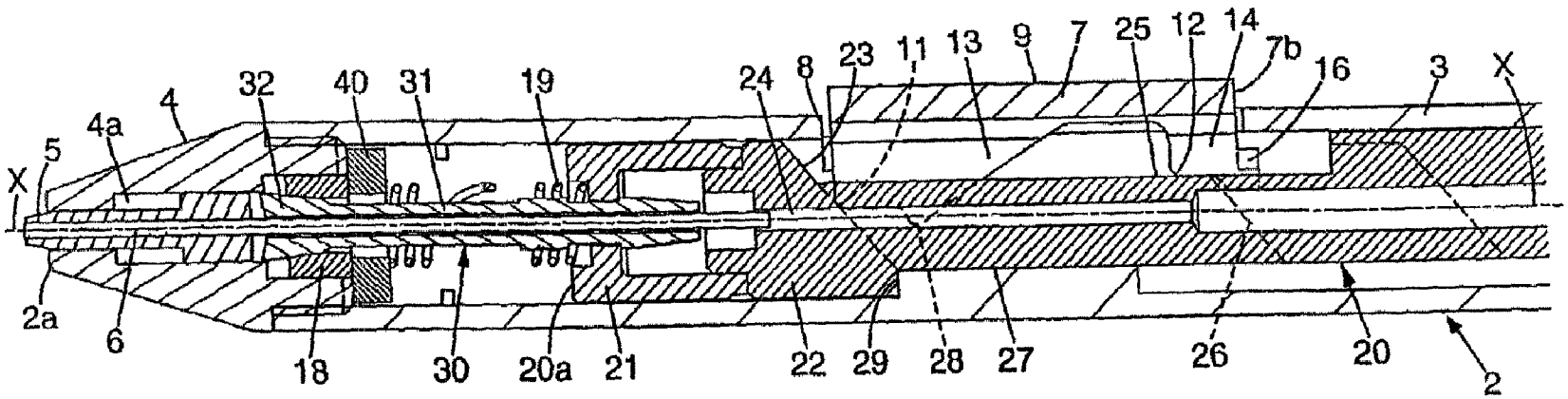
FIG. 2 is an enlarged view of a front section of the propelling pencil represented in FIG. 1.

Thus, when pressure is applied to the lateral button 7, from the rest position represented in FIGS. 1 and 2, the first pair of cams 11 interacts with the first pair of ramps 23 and causes a movement toward the front end 2*a* of the movable member 20.

A bearing 25 parallel to the longitudinal axis X is formed on the face of the movable member 20 opposite the lateral button 7. As is better seen in FIG. 5, the bearing 25 extends either side of the duct 24 and is positioned longitudinally so that the second pair of cams 12 of the lateral button 7 can rest on the latter when the lateral button is in the rest position.

A second pair of ramps 26 immediately follows the rear end of the bearing 25. The second ramps are situated either side of the lead storage compartment and are inclined relative to the longitudinal axis in a manner similar to the first ramps 23.

Figure 3:
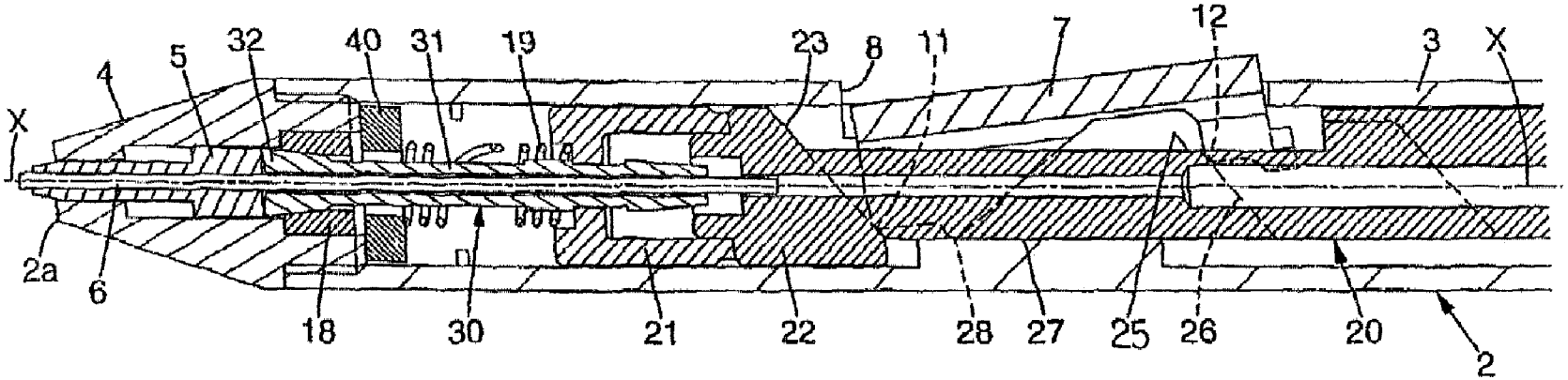
FIG. 3 is a view similar to FIG. 2, in which the lateral button has made a first tilting movement.

The second ramps 26 are distant longitudinally from the first ramps 23 so that the second pair of cams 12 is opposite the second ramps 26 when the lateral button has made a first tilting movement and is in the position shown in FIG. 3.

The body 2 of the propelling pencil comprises an abutment 27 which has a surface parallel to the longitudinal axis X and opposite the window 8 of the body. Each first cam 11 is extended rearward by a protruding boss 28 which forms a contact point against the abutment 27 when the lateral button 7 has made the first tilting movement.

The front end of the abutment 27 forms a radially internal rim which a radially external shoulder 29 of the movable member abuts in the rest position under the action of the spring 19. The abutment 27 is thus used to limit the retraction of the movable member 20.

The rear end 20*b* of the movable member, that is, in the embodiment shown, the rear end of the section 22*b* that forms the lead storage compartment, is fitted with an element 46 protruding through the rear end 2*b* of the body. The element 46 comprises a tubular portion sliding through the rear end 2*b* of the body, a fastener and a cylindrical recess in which an eraser 47 is mounted. The element 46 and the eraser 47 form a rear button which is used to move the movable member 20 forward.

The operation of the propelling pencil described above will be explained below with the aid of FIGS. 2 to 4.

In the rest position, shown in FIG. 2, the movable member 20 is held back against the abutment 27 under the action of the spring 19 which exerts a pressure on the front end 20*a* of the movable member. In this rest position, the first pair of cams 11 of the lateral button 7 is in contact on the first pair of ramps 23 and the second pair of cams 12 is resting on the bearing 25 of the movable member. However, it will be noted that the first 11 and second 12 pairs of cams could simply be facing the first pair of ramps 23 and the bearing 29, particularly if the lateral button 7 is forced outward by an elastic element.

From the rest position shown in FIG. 2, the user exerts with the index finger a pressure approximately centered on the actuation face 9. Because the second pair of cams 12 is resting on the bearing 25, the lateral button 7 makes a first tilting movement toward the inside of the body 2 and the front end 7*a* of the button passes through the window 8. The first pair of cams 11 interacts with the first pair of ramps 23 and thus the first tilting movement of the lateral button is transformed into a first longitudinal forward movement of the movable member 20. This first movement takes up the sliding clearance, called the "retraction stroke," of the tubular portion 31 of the chuck in the front piece 21 of the movable member, so that the front end 20*a* abuts a rim of the chuck, then the movable member 20 causes a first forward movement of the chuck 30.

During this first movement of the chuck, the ring 18 holds the head 32 of the chuck clamped on the lead and accompanies the movement of the latter.

The lead 6 slides through the lead-guide tip 5, but the latter may remain immobile in the bore 4*a* due to the greater friction force between the lead-guide tip 5 and the bore 4*a* than the friction force between the lead-guide tip 5 and the lead 6. As can be seen in FIG. 3, the lead 6 then emerges from the lead-guide tip.

At the end of the first tilting movement of the lateral button 7, and as shown in FIG. 3, the ring 8 abuts the rear end of the tip 4 and the protruding boss 28 of the first pair of cams 11 rests on the abutment 27 of the body.

It will be noted that, at the end of the first tilting movement, the second pair of cams 12 is facing the second pair of ramps 26 due to the forward movement of the bearing 25 during the first tilting movement. If the user maintains the pressure exerted on the actuation face 9, then a second tilting movement of the lateral button 7 is naturally obtained about the bearing point formed by the protruding boss 28 in contact with the abutment 27.

During this second tilting movement, the second pair of cams 12 interacts with the second pair of ramps 26 so that the movable member 20 makes a second forward movement. The ring 18 releases the head 32 of the chuck which opens and rests against the lead-guide tip 5. The lead-guide tip slides forward and due to the friction force exerted by the lead-guide tip 5 on the lead 6, the latter continues its forward movement, even though it is no longer clamped by the chuck during the second movement of the movable member.

It will be noted that, during the second tilting movement, only the second pair of cams 12 is in contact with the movable member, because the boss 28 is resting on the abutment 27 of the body 2. This is used to limit the friction forces between the lateral button 7 and the movable member 20 and, consequently, it is not necessary to greatly increase the pressure exerted on the lateral button to obtain the second tilting movement.

Figure 4:
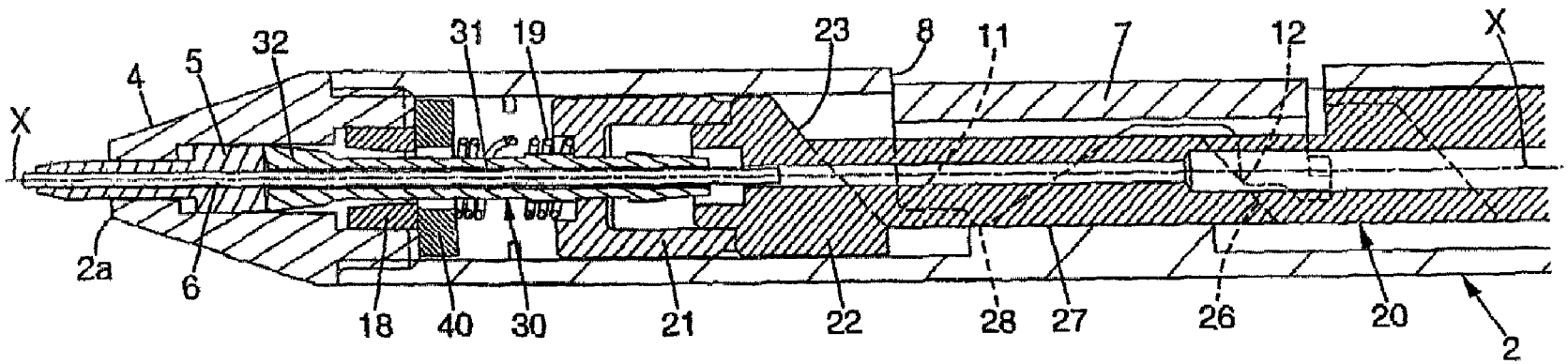
FIG. 4 is a view similar to FIG. 2, in which the lateral button has made a second displacement movement.

At the end of the second tilting movement of the lateral button 7, the propelling pencil is in the situation shown in FIG. 4 in which the lead 6 emerges from the front end of the lead-guide tip 5 which itself emerges from the opening of the tip 4 of the propelling pencil.

From the position shown in FIG. 4, if the user releases the pressure on the actuation face 9 of the lateral button, the spring 19 pushes the movable member 20 rearward, which results in a return of the lateral button 7 to the rest position under the action of the first and second pairs of ramps (23, 26) on the first and second pairs of cams (11, 12) of the lateral button. During this retraction movement of the movable member, the chuck 30 also makes a retraction movement, but the head 32 of the chuck remains open over virtually the whole length of this movement and therefore the lead makes virtually no retraction movement. Consequently, when the user releases the lateral button 7, the latter returns to the rest position and the chuck again clamps the lead 6, but the lead 6 and the lead-guide tip 5 remain in the utilization position as shown in FIG. 4.

It will be noted that, from this utilization position, it is sufficient to control only the first tilting movement of the lateral button 7 to make an additional quantity of lead protrude. This additional lead protrusion control therefore does not require the lateral button to be fully depressed and may be controlled rapidly and precisely by exerting a pressure only on the front end of the actuation face 9 of the button.

It is also possible to make the lead protrude from the lead-guide tip by actuating the rear button formed of the element 46 and the eraser 47 thanks to the rigid linkage of the element 46 with the movable member 20.

Naturally, this embodiment is in no way limiting and certain elements may be omitted without departing from the scope of the present invention. For example, the lead-guide tip 5, the movable sleeve 20 and the sliding assembly of the end of the chuck in the front portion 23 of the movable member are not necessary to obtain an increased advance movement of the movable member thanks to the dual tilting movement of the lateral button.

Furthermore, the exemplary embodiment described above is applied to a propelling pencil, but it will be clear to those skilled in the art that a similar mechanism with lateral button and movable member may be applied to other types of writing instruments, such as for example ballpoint pens.

In the case of the ballpoint protrusion control, it can be envisaged that the ramps of the movable member are inclined in opposite directions, so that, for example, the first tilting movement of the lateral button causes the tip to protrude, and that the second tilting movement causes the ballpoint to retract. In this case, it is also possible to provide a mechanism for latching the movable member after its first movement without departing from the scope of the present invention.

What is claimed is:

1. A writing instrument comprising:

a tubular body extending along a longitudinal axis between a rear end and a front end provided with an opening through which a writing tip is capable of protruding;

a lateral button having at least one actuation face oriented radially outward and at least one first cam arranged inside said body; and a writing tip advancing mechanism comprising a movable member movable in a longitudinal direction in said body, the movable member having at least a first ramp inclined relative to the longitudinal axis, wherein said lateral button being capable of remaining in a rest position in which the first cam is facing the first ramp, wherein said lateral button being capable of making a first tilting movement toward the inside of said body during which the first cam interacts with the first ramp and the movable member makes a first movement, wherein said lateral button has at least a second cam longitudinally distant from the first cam, and wherein the movable member further comprises a bearing substantially parallel to the longitudinal axis that is adjacent to at least one second inclined ramp, the second cam resting on the bearing during the first tilting movement of said lateral button, and facing the second ramp at the end of the first tilting movement, said lateral button being capable of making a second tilting movement toward the inside of said body during which the second cam interacts with the second ramp and the movable member makes a second movement.

2. The writing instrument according to claim 1, wherein said body has an abutment, and wherein the first cam has at least one contact point that is in contact against the abutment of said body during the second tilting movement of said lateral button.

3. The writing instrument according to claim 1, wherein at least one of the ramps of the movable member has a height, measured in a radial direction, substantially equal to the internal space of said tubular body.

4. The writing instrument according to claim 1, wherein said lateral button has, at the first and the second cams, a first and a second U-shaped cross section, the ends of the branches of the U-shaped cross section of the first and second cross sections forming the first and second cams.

5. The writing instrument according to claim 1, wherein the first ramp of the movable member is situated at the front end of said body and the second ramp is situated at the rear end.

6. The writing instrument according to claim 1, wherein said advancing mechanism further comprises an elastic element which forces the movable member toward the rear end of said body, the incline of the first and second ramps being adapted so that the first and second movements are made toward the front end of said body.

7. The writing instrument according to claim 6, wherein the writing tip is lead, and wherein said advancing mechanism further comprises a lead clamping chuck that is connected to the movable member.

8. The writing instrument according to claim 7, wherein the chuck is held closed under the action of at least one elastic element which forces the chuck and the movable member toward the rear end of said body.

9. The writing instrument according to claim 7, wherein the movable member has a central duct allowing at least one lead to pass through, and wherein the first and second ramps are formed by a first and a second pair of inclined surfaces situated on either side of the central duct.

10. The writing instrument according to claim 7, wherein a lead storage compartment is secured to the movable member and extends upward to a rear end provided with a rear button emerging from the rear end of said body.

11. The writing instrument according to claim 7, wherein a lead-guide tip is mounted so as to slide in the front end of said body between a retracted position and a protruding position, and wherein the first movement of the movable member is suitable for advancing and opening the chuck, and the second movement of the movable member is suitable for pushing the lead-guide tip into the protruding position.

* * * * *